US010031449B2

(12) United States Patent
Hashiguchi et al.

(10) Patent No.: US 10,031,449 B2
(45) Date of Patent: Jul. 24, 2018

(54) IMAGE HEATING DEVICE INCLUDING A CONTROLLER THAT EXECUTES FIRST AND SECOND HEAT CONTROLS BASED ON TEMPERATURES DETECTED BY FIRST AND SECOND DETECTING ELEMENTS

(71) Applicant: CANON KABUSHIKI KAISHA, Tokyo (JP)

(72) Inventors: Shinji Hashiguchi, Mishima (JP); Yusuke Hirota, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/392,351

(22) Filed: Dec. 28, 2016

(65) Prior Publication Data

US 2017/0192378 A1 Jul. 6, 2017

(30) Foreign Application Priority Data

Jan. 5, 2016 (JP) ..... 2016-000487

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 5,355,203 | A * | 10/1994 | Nishikawa | G03G 15/2053 219/216 |
| 5,915,146 | A * | 6/1999 | Kusaka | G03G 15/2003 219/216 |
| 8,027,607 | B2 | 9/2011 | Kurata et al. | |
| 8,326,169 | B2 | 12/2012 | Kurata et al. | |
| 9,405,249 | B2 | 8/2016 | Hirai et al. | |
| 2005/0258158 | A1* | 11/2005 | Takami | G03G 15/2042 219/216 |
| 2012/0033987 | A1* | 2/2012 | Ikegami | G03G 15/5029 399/82 |

FOREIGN PATENT DOCUMENTS

| | | |
|---|---|---|
| JP | 2002-91226 A | 3/2002 |
| JP | 2004-78181 A | 3/2004 |
| JP | 2006-154061 A | 6/2006 |
| JP | 2009-75439 A | 4/2009 |
| JP | 2009-186891 A | 8/2009 |

* cited by examiner

*Primary Examiner* — G. M. Hyder
(74) *Attorney, Agent, or Firm* — Fitzpatrick, Cella, Harper & Scinto

(57) ABSTRACT

An image heating apparatus for heating an image on a recording material. A controller executes a first heater control so that a temperature detected by a second temperature detecting element is maintained at a target temperature of the heater. The controller executes a second heater control for controlling the heater so that a temperature detected by a first temperature detecting element is maintained at a target temperature. When the first heater control is executed, the controller corrects the target temperature of the heater in accordance with the temperature detected by the first temperature detecting element, and when the second heater control is executed, a feeding speed of a recording material in a nip is less than that when the first heater control is executed.

6 Claims, 12 Drawing Sheets

<table>
<tr><th>SHEET</th><th>WIDTH</th><th>P. SPEED</th><th>T. CONT.</th></tr>
<tr><td>A3 LONG.</td><td>297</td><td rowspan="2">135mm/s</td><td rowspan="4">SLV.<br>THMSTR<br>+<br>THR.<br>THMSTR</td></tr>
<tr><td>B4 LONG.</td><td>257</td></tr>
<tr><td>A4 LONG.</td><td>210</td><td rowspan="8">67.5mm/s</td></tr>
<tr><td>B5 LONG.</td><td>182</td></tr>
<tr><td>A5 LONG.</td><td>148</td><td rowspan="8">SLV.<br>THMSTR</td></tr>
<tr><td>B6 LONG.</td><td>128</td></tr>
<tr><td>A6 LONG.</td><td>105</td></tr>
<tr><td>B7 LONG.</td><td>91</td></tr>
<tr><td>POST CARD</td><td>100</td></tr>
<tr><td>ENVLP (L3)</td><td>120</td></tr>
</table>

Fig. 8

IMAGE HEATING DEVICE INCLUDING A CONTROLLER THAT EXECUTES FIRST AND SECOND HEAT CONTROLS BASED ON TEMPERATURES DETECTED BY FIRST AND SECOND DETECTING ELEMENTS

FIELD OF THE INVENTION AND RELATED ART

The present invention relates to an image forming apparatus of an electrophotographic type or the like, including an image heating apparatus, for forming an image on a recording material, such as a copying machine, a printer, a facsimile machine or the like, and relates to an image heating device for such an image forming apparatus.

A heating roller type or belt (film) heating type or the like is known for a fixing device as an image heating apparatus usable with an image forming apparatus. The heating roller type is good in a heat efficiency and/or a reliability or the like. The belt heating type is energy saving type in that it has a quick start property (on-demand type), and the electric power supply during a stand-by period is minimized, thus reducing the electric energy consumption.

In the belt heating type fixing device, a heat resistive endless belt (sleeve) is nipped between a ceramic heater as a heating element and a pressing roller as a pressing member to form a nip (fixing nip). The recording material (sheet) carrying an unfixed toner image is introduced to the nip and is fed by the nip. In this manner, in the nip, heat is applied to the sheet through the sleeve from the ceramic heater, and a pressure is applied by the nip to fix the unfixed toner image into a fixed image on the sheet.

The ceramic heater and the sleeve as a fixing member has a small thermal capacity, and the warming-up time can be reduced. On the other hand, it requires a control against temperature rise in a non-sheet-passage-part and a stabilized temperature control.

When the sheets having widths smaller than a maximum width usable by the device are continuously supplied into the fixing device, the non-sheet-passage-part temperature rise occurs in the areas in the nip not passed by the sheets, because the heat is not transferred to the sheets. JP 2002-91226 discloses a example of means for preventing breakage of the parts of the device caused by the non-sheet-passage-part temperature rise, and the printable number (throughput, productivity) per unit time is enhanced. More particularly, a temperature detecting element for detecting a ceramic heater temperature in the non-sheet-passage-part, and when the temperature detecting element detects a predetermined temperature, sheet feeding timing is delayed.

JP 2004-78181 discloses an example of a stabilized temperature control. More particularly, a temperature detecting element is provided for a sleeve, and the detection result is fed back to the electric power supply to the ceramic heater.

JP 2009-75439 discloses means for preventing temperature ripple when the thermal resistance between the sleeve and the ceramic heater as the heat source, thus accomplishing precise temperature control. More particularly, in addition to the temperature detecting element for detecting that the temperature of the sleeve, a temperature detecting element for detecting that the temperature of the ceramic heater to properly control the temperature of the sleeve.

Recently, the demand for the productivities for various sizes of sheets, and therefore, a plurality of temperature detecting elements are provided for detecting the temperature rise in the non-sheet-passage-part. However, with the increase of the number of temperature detecting elements in the sleeve, it becomes difficult to assure the space dedicated for the temperature detecting elements. In addition, the cost increase will result by the necessity of wiring the signal lines for the temperature detecting elements, complication of the electric circuits and the increase of the number of temperature detecting elements.

SUMMARY OF THE INVENTION

According to one aspect the present invention provides an image heating apparatus for heating an image on a recording material, the image heating apparatus comprising a cylindrical film, a heater contacting an inner surface of the film, a roller cooperative with the heater to form a nip with said film, a first temperature detecting element configured to detect a temperature of the film in a first area of the film that is passed by a minimum width recording material that is capable of being fed by the apparatus, a second temperature detecting element configured to detect a temperature of the heater in a second area of the heater that is outside of an area to be passed by a minimum width recording material that is capable of being fed by the apparatus and which is passed by a maximum width recording material that is capable of being fed by said apparatus, a third temperature detecting element configured to detect a temperature in a third area of the heater that is outside of the second area with respect to an longitudinal direction of the heater, and a controller configured to control said heater, wherein said device heats the recording material carrying the image while passing through the nip, wherein, when the recording material having a width sufficient enough to pass both the first area of the film and the second area of the heater is heated, the controller executes a first heater control for controlling the heater on the basis of both of the temperature detected by the first temperature detecting element and the temperature detected by the second temperature detecting element, and wherein, when the recording material having a width so as to pass the first area of the film and not to pass the second area of the heater is heated, the controller executes a second heater control for controlling the heater on the basis of the temperature detected by the first temperature detecting element, irrespective of the temperature detected by the second temperature detecting element.

Further features of the present invention will become apparent from the following description of exemplary embodiments with reference to the attached drawings.

BRIEF DESCRIPTION OF THE DRAWINGS

FIG. 8 an illustration of a control for the respective sheet widths.

DESCRIPTION OF THE EMBODIMENTS

The embodiments of the present invention will be described. The function, material, configuration, positional relations and the like of the elements described herein below is not limiting to the present invention unless otherwise stated. As for the material, configuration and the like of the elements described once apply to the subsequent descriptions unless otherwise stated.

Embodiment 1

<Image Forming Apparatus>

Figure 2:
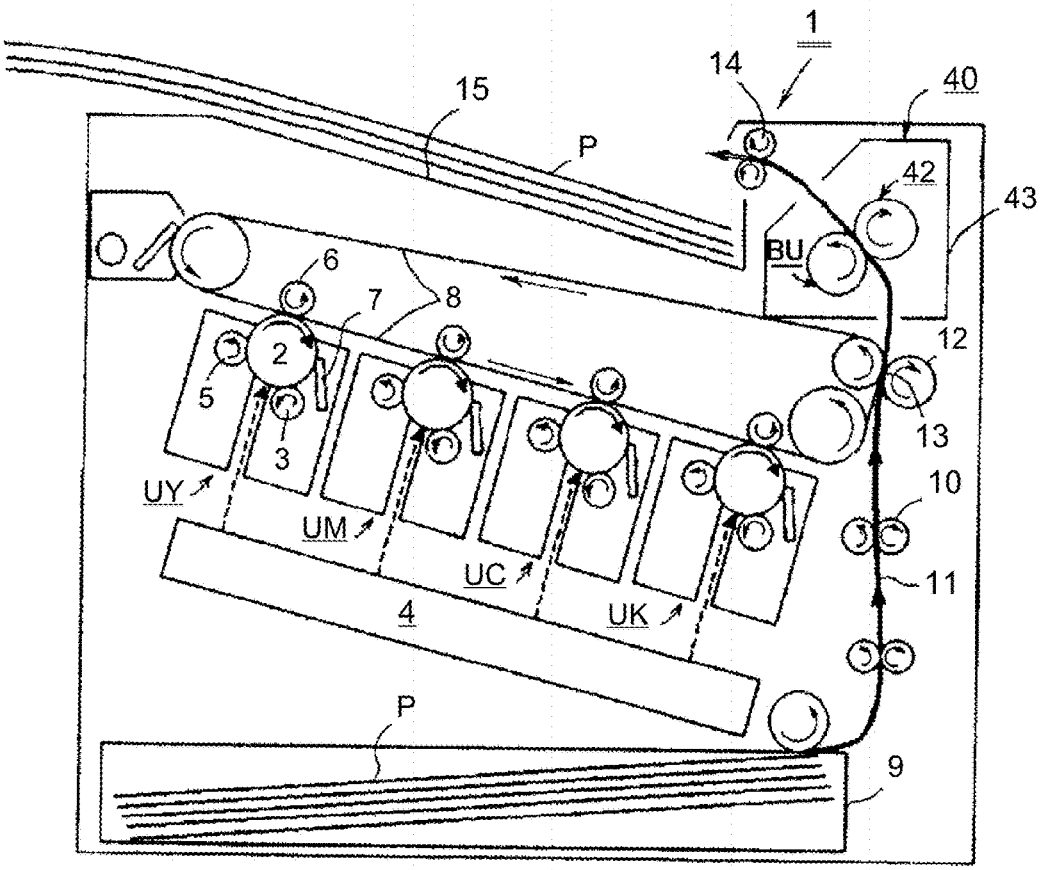
FIG. 2 is a schematic view of an example of an image forming apparatus.

FIG. 2 is a general arrangement of an image forming apparatus 1 in Embodiment 1. The image forming apparatus 1 is a tandem type and intermediary transfer type electrophotographic laser beam printer capable of forming a full-color images, by four image forming stations UY, UM, UC, UK using Y (yellow), M (magenta), C (cyan) and K (black) toners, respectively.

The image forming stations each include a photosensitive drum 2, a charger 3, a laser scanner 4, a developing device 5, a primary transfer charger 6 and a drum cleaner 7. For simplification of explanation, the reference numerals of the image forming stations other than image forming station UY are omitted. An electrophotographic process and image forming operation of the image forming stations are known, and therefore, the description thereof is omitted.

The toner images of the respective colors are transferred from the drums 2 the image forming stations are superimposedly transferred onto an intermediary transfer belt 8 (primary-transfer). By this, four color superimposed toner image is formed on belt 8. On the other hand, a sheet P is singled out from a cassette 9 accommodating sheets (recording material). The sheet P is introduced to a secondary transfer nip 13 which is a press-contact portion provided by the belt 8 and a secondary transfer roller 12, at predetermined control timing through the feeding path 11 including a pair of registration rollers 10. By this, the four color superimposed toner image is transferred from the belt 8 onto the sheet P (secondary-transfer).

The sheet P is introduced to a fixing device (image heating apparatus) 40, when the toner image is fixed. The sheet P discharged from the fixing device 40 is discharged onto a discharging tray 15 by a pair of discharging rollers 14. In each of the image forming stations, the photosensitive drum 2, the charger 3, the developing device 5 and the drum cleaner 7 are unified into a process cartridge detachably mountable to a predetermined mounting portion of a main assembly of the image forming apparatus.

The maximum process speed of the image forming apparatus 1 according to this embodiment is 135 mm/s, and the throughput thereof is 30 ppm (A4 size lateral feeding). The maximum usable sheet width of the sheet P (maximum sheet width) is 297 mm (A4 size lateral feeding, and A3 size longitudinal feeding), and the minimum width (minimum sheet width) is 76 mm. In the feeding of the sheets P, the centers of the sheet widths of the sheets having various widths are aligned with the feeding path. However, one longitudinally extending edges of the sheets may be aligned.

<Fixing Device>

Figure 3:
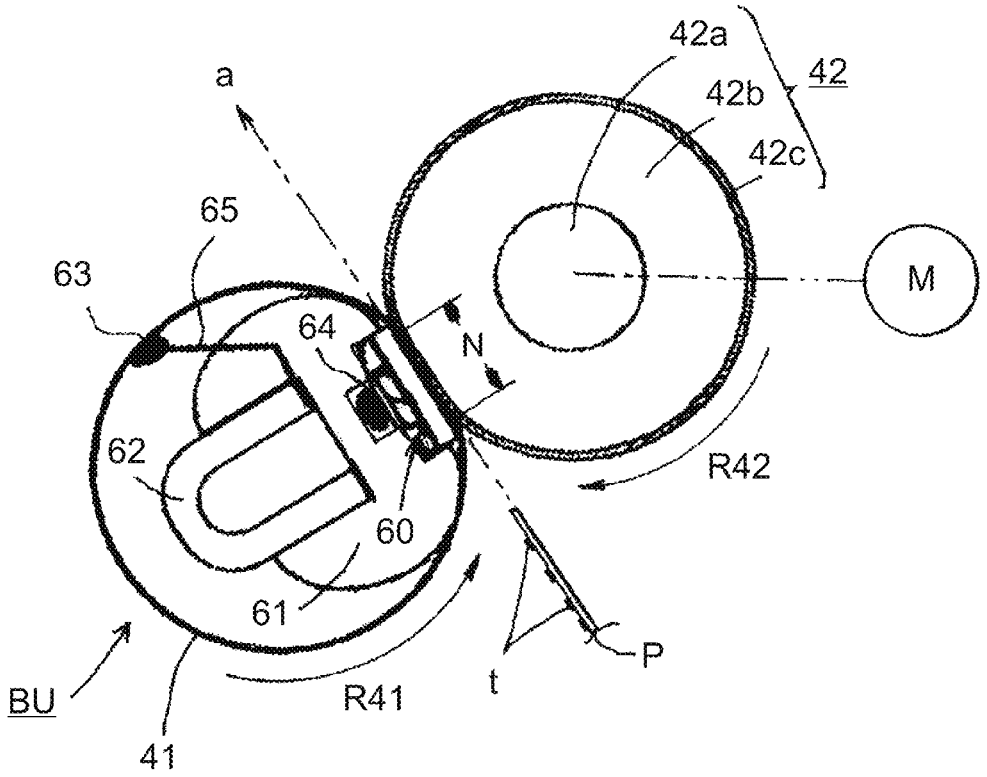
FIG. 3 a lateral schematic sectional view of major parts of a fixing device according to an embodiment of the present invention.
Figure 4:
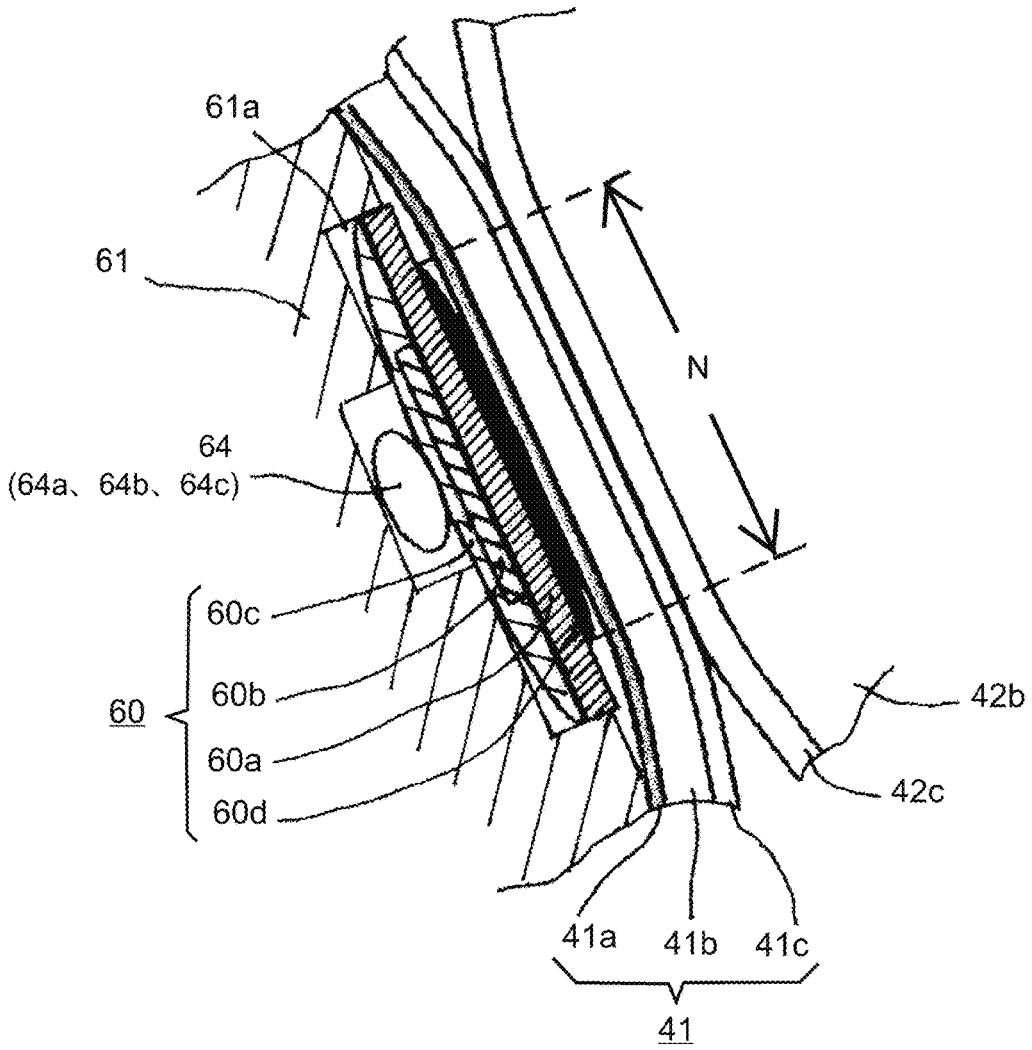
FIG. 4 is a partial enlarged schematic view.
Figure 5:
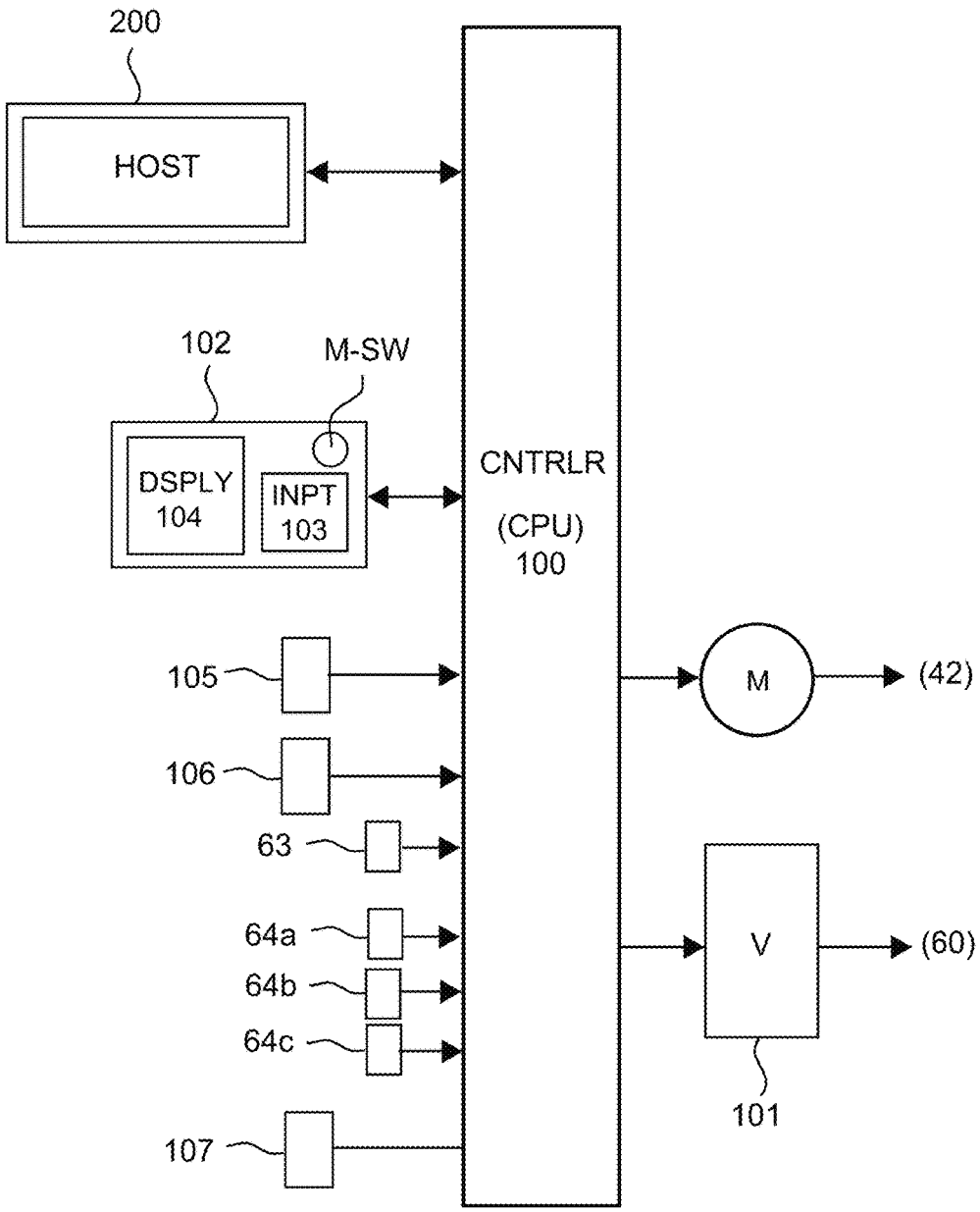
FIG. 5 is a block diagram of a control system.

FIG. 3 is a schematic enlarged cross-sectional view of major parts of the fixing device 40, FIG. 4 is a partial enlarged view of a part of FIG. 3, and FIG. 5 is a block diagram of the control system. The fixing device 40 is a belt (film) heating type and pressing member drive type (tensionless type) on-demand fixing device (OMF fixing device). The fixing device 40 generically comprises a belt unit BU, a pressing roller 42 as a nip forming member cooperative with the belt unit BU to form a nip (fixing nip) N, and a device frame (casing) 43 (FIG. 2) accommodating them.

(Belt Unit)

The belt unit UF includes an endless belt (sleeve) 41 as a movable member (heat transfer member). The belt unit UF father includes a heater 60 is a heating element provided inside the sleeve 41 and the functioning also as a back-up member, a heater holder 61 supporting the heater 60, and a stay 62 supporting the heater holder 61. The internal members 60-62 in the sleeve are elongated in a longitudinal direction (widthwise direction) of the sleeve 41.

The stay 62 has one end portion and a other end portion which are extended and the projected out of the respective end portions of the sleeve 41, and flange members (unshown) are provided on the respective projections. The sleeve 41 is loosely fitted around the outside of the internal members 60-62 between the flange members.

The sleeve 41 in this embodiment comprises a cylindrical base layer 41*a*, an elastic layer on the outer periphery thereof, and a parting layer on the outer periphery of the elastic layer 41*b*. The sleeve 41 has a cylindrical shape having an outer diameter of 24 mm in a free state.

The material of the base layer 41*a* is resin material such as polyimide or the like, or metal such as SUS or the like. In this embodiment, it is SUS having a thickness of 30 μm in view of the required strength. From the standpoint of quick start performance, the elastic layer 41*b* preferably has a thermal conductivity as high as possible. In view of this, in this embodiment, the elastic layer 41*b* is made of silicone rubber having a thermal conductivity of approx. 1.0×10-3 cal/sec·cm·K and having a thickness of 250 μm.

The parting layer 41*c* is provided to prevent toner offset phenomenon-which means that the toner is deposited on the surface of the sleeve 41 and then transferred onto the sheet P. The material of the parting layer 41*c* is fluorinated resin material or silicone resin material such as PTFE, PFA or the like. In this embodiment, the parting layer 41*c* is a PFA tube having a thickness of approx. 30 μm, and the PFA tube coats the outer peripheral surface of the silicone rubber.

The heater 60 in this embodiment is a ceramic heater having a low thermal capacity and is capable of steeply rising in temperature in response to electric power supply to a heat generating resistor layer thereof. The heater 60 includes an elongated substrate (base) 60*a*. The substrates 60*a* is an insulative substrate having a high thermo-conductivity and is made of ceramic material such as alumina or aluminum nitride or the like. The substrate 60*a* in this embodiment is a rectangular alumina substrate having a thickness of 1 mm, a width of 8 mm and a length of 375 mm in consideration of the thermal capacity and the strength.

On the back side of the substrate 60*a* (the opposite side of the side contacting the inner surface of the sleeve 41), there is provided a heat generating resistor layer 60*b* as a heat generating element extending in the longitudinal direction of the substrate 60*a*. The heat generating resistor layer 60*b* mainly comprises AgPd alloy, NiSn alloy, RuO2 alloy or the like and is molded to a thickness of approx. 10 μm, a length of 310 mm in the width of 4 mm. The heat generating resistor layer 60*b* generates heat by being supplied with electric energy from a voltage source portion 101 controlled by a controller (CPU) 100 to the electrode portion (unshown) at the opposite ends.

The back side of the substrate 60*a* is coated with the insulation glass layer 60*c* on the heat generating resistor layer 60*b* side. The insulation glass layer assures the insulative property relative to the outer electroconductive members, and functions as an anti-eating function means for preventing resistance value change attributable to oxidation or the like of the heat generating resistor layer 60*b* and functions also as means for preventing mechanical damage. The thickness of the insulation glass layer 60*c* is approx. 30 μm.

The substrate 60*a* is provided at the surface thereof with a sliding layer 60*d* in the sliding contact with the inner surface of the sleeve 41. The sliding layer 60*d* is made of imid resin material such as polyimide, polyamide-imide or the like material and has a thickness of 6 μm. The sliding layer 60*d* exhibits high heat resistivity, high lubricity, high anti-wearing property and smooth slidability relative to the inner surface of the sleeve 41.

The heater holder 61 is provided with a longitudinally extending groove portion 61*a* in which heater 60 is fitted and fixed by a heat resistive adhesive or the like with the heater surface side (sliding layer 60*d* side surface) facing outward. The heater holder 61 functions as a back-up member for the sleeve 41 of the heater 60, as means for applying pressure to the nip N and as means for stabilizing the feeding during the rotation of the sleeve 41. The heater holder 61 is made of liquid crystal polymer resin material from the standpoint of sliding, heat-resistive and installation properties.

The stay 62 supporting the heater holder 61 is required to have a rigid enough to apply the pressure to the nip N and is made of steel, for example. It is pressed against the side of the heater holder 61 away from the heater 60 to reinforce the heater holder 61 and the heater 60, thus assuring the nip N. Simultaneously, it is effective to assure the strength of the belt unit BU by connecting with the flange members.

For the heater 60, there is provided a heater thermister (temperature detecting element) 64 (64*a*, 64*b*, 64*c*) for detecting a temperature of the heater. In the longitudinally central portion of the heater holder 61, there is provided a sleeve thermister (first temperature detecting element) 63 for detecting a temperature of the sleeve 41 through an elastic supporting member 65. The sleeve thermister 63 is elastically contacted to an inner surface of the sleeve 41 at a widthwise central portion. By this, a proper contact state relative to the inner surface of the sleeve 41 is maintained even if the sensor contacting surface of the rotating sleeve 41 waves or changes in its position, because the sleeve thermister 63 follows the waving or position change.

(Pressing Roller)

The pressing roller 42 comprises a core metal 42*a*, an elastic layer 42*b* integrally coating the outer peripheral surface of the core metal 42*a*. A surface layer (parting layer) 42*c* may be provided. The elastic layer 42*b* is made of heat resistive rubber such as silicone rubber, fluorine-containing rubber or the like, or foam member of silicone rubber. The surface layer 42*c* may be PFA tube. The core metal 42*a* of the pressing roller 42 is rotatably supported through bearings by side plates (unshown) of the apparatus frame 43.

The belt unit BU is opposed to the pressing roller 42 at the heater 60 side thereof in parallel with the pressing roller 42. The flange members at the one end portion side and the other end portion side are slidably supported by the side plates of the apparatus frame 43 so as to be movable toward the pressing roller 42. Predetermined the pressures (load) are applied to the flange members toward the pressing roller 42.

By the pressures, the stay 62 and the heater holder 61 are urged toward the pressing roller 42, so that the heater 60 is elastically urged to the pressing roller 42 through the sleeve 41 therebetween. By this, the nip N having a predetermined width measured in the direction of a sheet feeding (recording material feeding) is formed between the sleeve 41 and the pressing roller 42.

(Fixing Operation)

To the core metal 42*a* of the pressing roller 42, a driving force is transmitted from a driving motor (driving means) M Controlled by the controller 100 through a drive transmission mechanism (unshown). By this, the pressing roller 42 is rotated in the clockwise direction indicated by an arrow R42 in FIG. 3 at a predetermined peripheral speed, as a driving rotatable member. By the rotation of the pressing roller 42, the sleeve 41 of the belt unit BU rotates in a counterclockwise direction indicated by an arrow R41 with the inner surface thereof in close contact with the surface of the sliding layer 60*d* (surface of the heater 60). The heater holder 61 functions as a rotation guiding member for the sleeve 41.

In addition, to the heat generating resistor layer 60*b* of the heater 42, electric, and is supplied from the voltage source portion 101 controlled by the controller 100. By the electric power supply, the heat generating resistor layer 60*b* generates heat so that the temperature of an effective heat generating area (full-length of heat generating resistor layer 60*b*) steeply rises.

The temperature of the heater 42 is detected by a heater thermister 64 (second temperature detecting element), and the temperature of the sleeve 41 is detected by a sleeve thermister (first temperature detecting element) 63, and the detected temperatures are fed back to the controller 100. The controller 100 responds to the detected temperatures fed back thereto to control the electric power supply from the voltage source portion 101 to the heat generating resistor layer so as to maintain a predetermined control temperature (target temperature) of the heater 60. In other words, the controller 100 controls the electric power supply to the heater 60 to effect the temperature control for the heater 60, on the basis of the detection results of the 64 and the sleeve thermister 63. This will be described in more detail hereinafter.

The sheet P carrying an unfixed toner image t fed from the image forming station to the fixing device 40 is introduced to the nip N, which needs and the feeds the sheet P. By this, the sheet P is simultaneously heated and pressed in the nip N, so that the toner image t is fixed into a fixed image on the sheet P. The sheet P having passed through the nip N is separated from the surface of the sleeve 41 (curvature separation) and is discharged.

(Controller)

In the control system shown in FIG. 5, the controller 100 overall controls the image forming operation of the image forming apparatus 1 in response to image information signal of a print job supplied from a host apparatus 200 such as a personal computer (PC), image reader or the like. FIG. 5 mainly shows the control system for the fixing device 40.

Designated by reference numeral 102 is an operating portion of the image forming apparatus 1. The operating portion 102 is a user interface (UI: User Interface, inputting means, displaying means) for inter-communication of electrical information with the controller 100. Using the operating portion 102, the user (operator) instructs image forming mode setting or the like to the controller 100. In addition, the device state, notification or the like is given from the controller 100 to the user using the operating portion 102.

The operating portion 102 includes a main switch M-SW, an input portion (operation panel) 103, a display portion (display screen: UI screen) 104. The input portion 103 includes ten-keys for entering numbers, a print start key, a stop key, a power-saving key and so on. The display portion 104 includes a touch panel type liquid crystal screen which displays selectable sheet the sizes and various operation buttons (panel menus) and so on. Various settings for the operations of the image forming apparatus can be supplied to the controller 100 by the displayed operation buttons.

(Disposition of Temperature Detecting Element)

Figure 6:
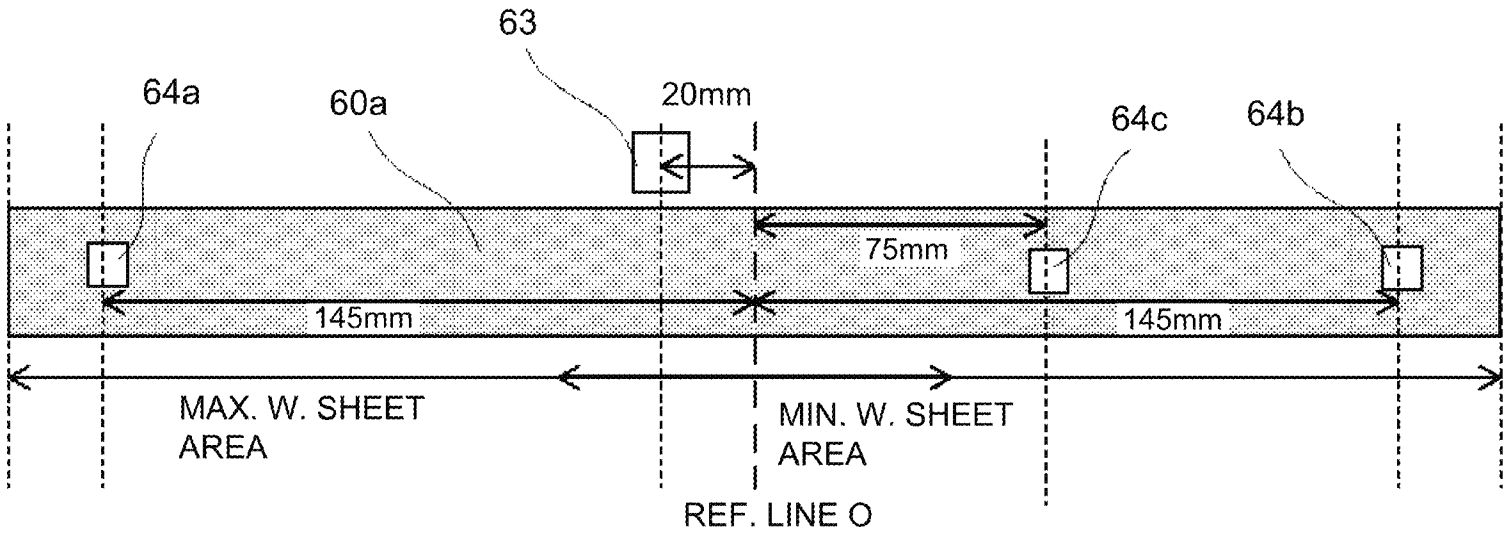
FIG. 6 is an illustration of position of temperature detecting element in Embodiments 1 of the present invention.

Referring to FIG. 6, the description will be made as to the positions of the sleeve thermister 63 and the heater thermister 64 (64*a*, 64*b*, 64*c*) in the belt unit BU. In the image forming apparatus 1 of this embodiment, the sheet feeding is based on is center alignment type. Designated by O is the center reference line (sheet processing reference: imaginary line). The sleeve thermister 63 is at a position 20 mm away from the center reference line O in one longitudinal direction of the sleeve 41, which is within a range of sheet passage even when a sheet of minimum usable width (76 mm width in this embodiment) is passed.

The sleeve thermister 63 as the first temperature detecting element for detecting the temperature of the sleeve 41 is disposed in the range in which the sheet having the usable minimum width passes do detected temperature of the sleeve portion corresponding to such a range.

The heater thermisters 64*a*, 64*b*, 64*c* are disposed at three positions on the back side of the heater substrate 60*a*. The heater thermister (fourth temperature detecting member) 64*a* and the heater thermister (third temperature detecting member) 64*b* are disposed at positions 145 mm away from the center reference line O toward one and the other sides in the longitudinal direction of the heater substrate 60*a*, respectively, as end thermisters. By this, a non-sheet-passage-part temperature rise of the heater 60 can be detected (monitored) when the sheet having a width of less than 290 mm which is smaller than the maximum usable width is fed.

The heater thermister 64*c* is disposed 75 mm away from the center reference line O toward the other side in the longitudinal direction of the heater substrate 60*a* as a central portion thermister (second temperature detecting element). By this, the non-sheet-passage-part temperature rise of the heater 60 can be detected when the sheet having a width less than 150 mm is fed.

That is, the heater thermister 64*c* as the second temperature detecting element for detecting the temperature of the heater 60 is disposed in the area in which the usable minimum width sheet does not pass and in which the usable maximum width sheet passes.

(Sheet Width Detecting Means)

In the case that the sheet cassette 9 is provided with a sheet width sensor 105 for detecting the width of the sheets accommodated therein, the controller 100 is capable of acquiring the sheet width from the information from the sheet width sensor 105.

In the case that a sheet width sensor 106 for detecting the width of the sheet is provided at any position of a sheet feeding path 11 from the cassette 9 to the fixing device 40, the controller 100 is capable of acquiring the width of the sheet from the sheet width sensor 106.

The sheet width detecting means is not limited to such a means, but may be acquired from the input to the operating portion 102, the host apparatus 200 or the like upon the printing.

(Feeding Speed Determination Responsive to Sheet Size)

In this embodiment, the process speed (recording material feeding speed) of the image forming apparatus 1 is changed in accordance with the detection result of the sheet width detecting means (width of recording material used) This is well-known from the standpoint of suppressing the non-sheet-passage-part temperature rise in the fixing device 40 to enhance the productivity when small width sheets are continuously introduced in an image formation (continuous print). For example, Japanese Laid-open Patent Application 2001-2279 discloses such technique.

In the image forming apparatus 1 of the embodiment, the controller 100 can change the process speed between a first feeding speed (high speed mode) and a second feeding speed (low speed mode) which is lower than the first feeding speed.

Figure 1:
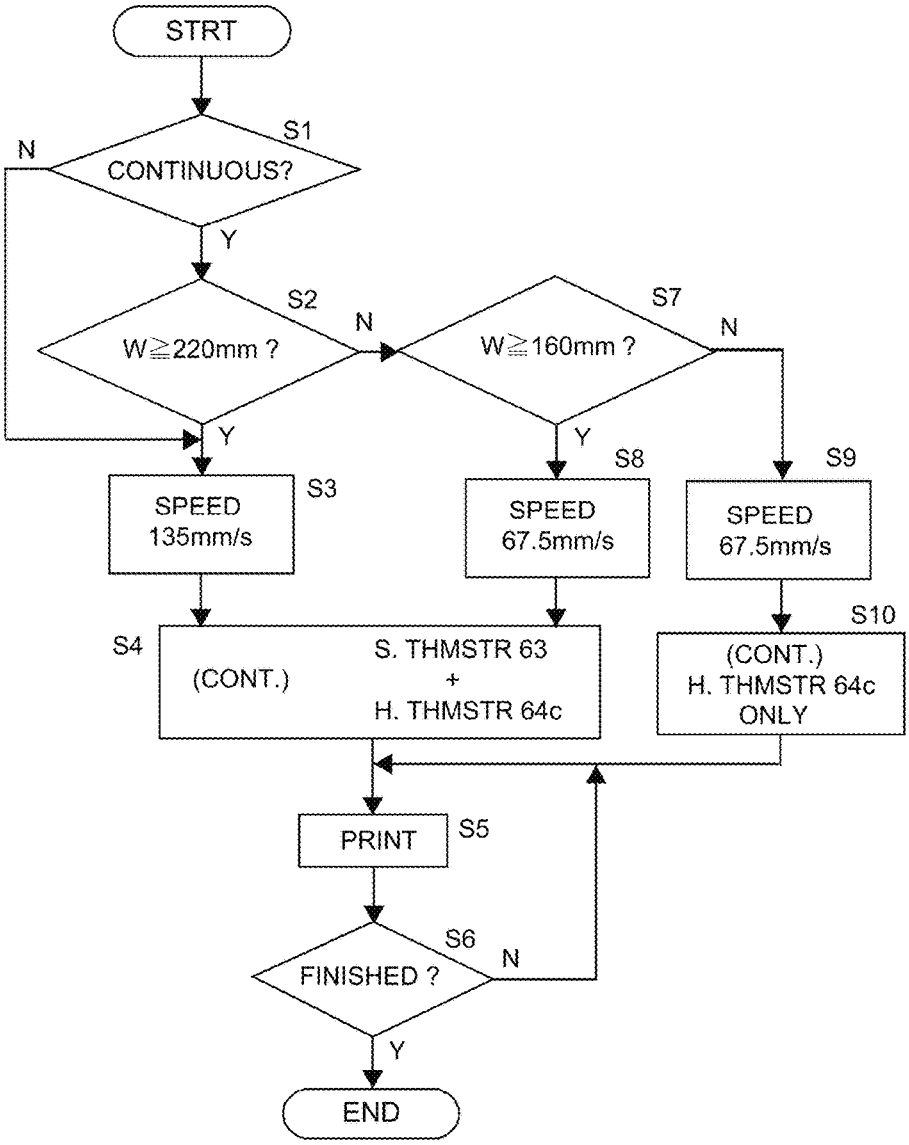
FIG. 1 is a control flow view.

As shown in control flow of FIG. 1, when the sheet width is larger than 220 mm (not less than second threshold), the printing operation is carried out at a process speed of 135 mm/s (first feeding speed). When the sheet width less than 220 mm (less than second threshold), the printing operation is carried out at a process speed of 67.5 mm/s (second feeding speed). By decreasing the process speed, an image defect attributable to the fixing temperature can be suppressed, in addition to the enhancement of the productivity for the small size sheets.

Figure 7:
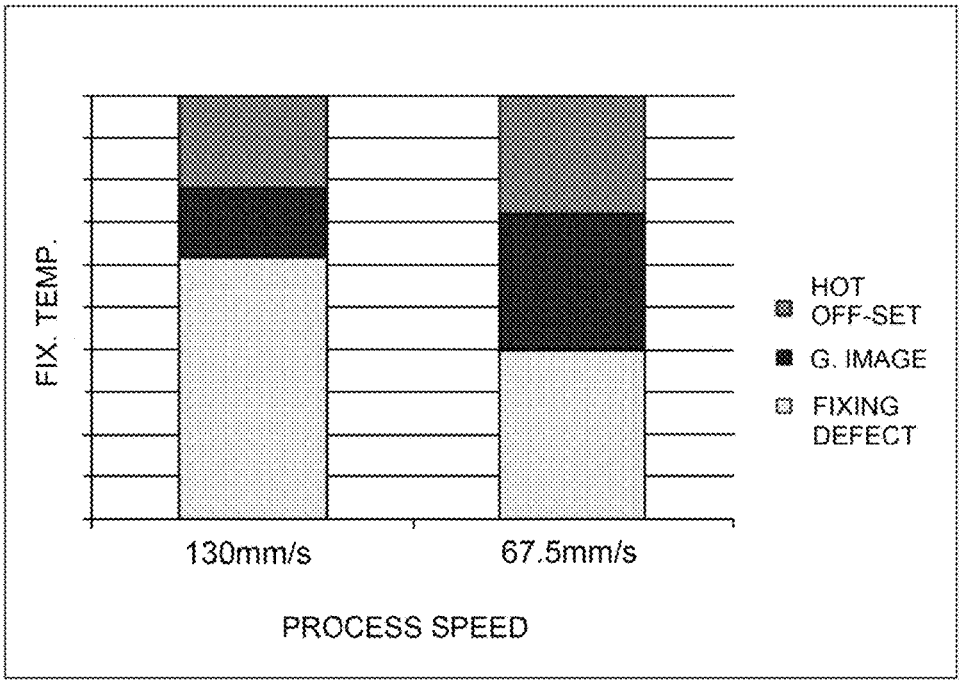
FIG. 7 is an illustration of the relationship between a fixing temperature and the image defect in Embodiments 1.

Referring to FIG. 7, the relationship between the fixing temperature and the image defect when the process speed is 135 mm/s and 67.5 mm/s will be described. When the temperature of the sleeve 41 is too high, a part of the fused toner remains on the sleeve 41 and transfers onto the sheet after one full-turn of the sleeve (so-called hot offset). On the other hand, when the temperature of the sleeve 41 is too low, the toner on the sheet does not sufficiently fuse with the result of easy removal of the toner from the sheet after the image fixing operation (improper fixing). FIG. 7 shows the improper fixing and the hot offset when the process speed is 135 mm/s and 67.5 mm/s.

In the case of 67.5 mm/s of the process speed, the time duration required for the sheet to pass through the nip N is longer than in the case of 135 mm/s of the process speed, and therefore, the improper fixing can be prevented even with a low temperature. The hot offset is influenced not only by the heat quantity but also by the absolute temperature, and therefore, the temperature at which the hot offset begins to occur does not significantly change. As a result, as will be understood from FIG. 7, a satisfactory temperature area in which the improper fixing or the hot offset is not produced is relatively wider in the case of 67.5 mm/s of the process speed.

(Temperature Control)

The temperature control of the heater 60 (control of the electric power supplied to the heater) will be described. The temperature control for the heater 60 changes as follows in accordance with the detection result of the sheet width.

1) Not Less than 160 mm of the Sheet Width:

In this case (not less than first threshold), both of the sleeve thermister 63 and the heater thermister 64*c* are within the sheet passing area even when the feeding position of the sheet is deviated and/or the sheet sizes of are varied. Therefore, the temperature control is carried out using both of the sleeve thermister 63 and the heater thermister 64*c*.

That is, when the sheets are continuously processed for the image formation, the controller 100 changes the control mode (electric power control mode) of the operation of the heater 60 in response to the width of the sheet to be processed. In this case, when the sheet width is not less than a predetermined first threshold, the first heater control mode (first electric power control mode) using of both of the sleeve thermister 63 and the heater thermister 64*c* is selected for the temperature control.

More particularly, a target temperature is set for the sleeve thermister 63, and the detected temperature of the sleeve thermister 63 is compared with the target temperature. In response to the difference, the control temperature of the heater thermister 64*c* is changed. More particularly, if the value resulting from subcontracting the detected temperature from the target temperature for the sleeve thermister 63 is larger than a predetermined value, the control temperature (target temperature) of the heater 64*c* is made higher than when the value is not larger than the predetermined value.

With such a control mode, the non-sheet-passage-part temperature rise is detected by the heater thermisters 64*a* and 64*b*, while maintaining the sleeve thermister temperature at the target temperature.

2) Less than 160 mm of the Sheet Width:

In this case (less than first threshold), if the deviation of the sheet feeding or a variation of the recording material, what is assuredly within the sheet passing area is the sleeve thermister 63 only. Therefore, the temperature control is carried out using the sleeve thermister 63. The controller 100 selects the second heater control mode (second electric power control mode) using the sleeve thermister 63. In the second heater control mode, the heater 60 is controlled in response to the detected temperature of the sleeve thermister 63 irrespective of the detected temperature of the heater thermister 64*c*.

When the sheet width is less than 150 mm, the heater thermister 64*c* can be used for the non-sheet-passage-part temperature rise detection, and therefore, the productivity for the small size sheets can be assured.

On the other hand, because the temperature control is carried out using only the sleeve thermister 63, variation of the temperature of the sleeve thermister 63 relative to the target temperature (temperature ripple) arises.

However, as described hereinbefore, the process speed for the sheet width of less than 220 mm is 67.5 mm/s. Therefore, as shown in FIG. 7, the satisfactory temperature area for the image property is wide, and therefore, even if the temperature of the sleeve thermister 63 varies, the improper fixing or the hot offset does not arise.

The combination of the control mode and the feeding speed is as shown in FIG. 8, and as will be understood therefrom, when the temperature control is carried out in the mode using only the sleeve thermister 63, the process speed is 67.5 mm/s.

(Property Comparison)

A control stability of the sleeve temperature and a non-sheet-passage-part temperature rise detection property in processing small size sheet processings with respect to the structures of Embodiment 1 with the above-described temperature control have been confirmed. Similar confirmations have been carried out for comparison example 1 and comparison example 2.

In comparison example 1, the dispositions of the sleeve thermister 63 and the heater thermisters 64*a*, 64*b*, 64*c* are the same as with Embodiment 1 (FIG. 6), but the temperature control is carried out in the control mode using only the sleeve thermister 63.

Figure 9:
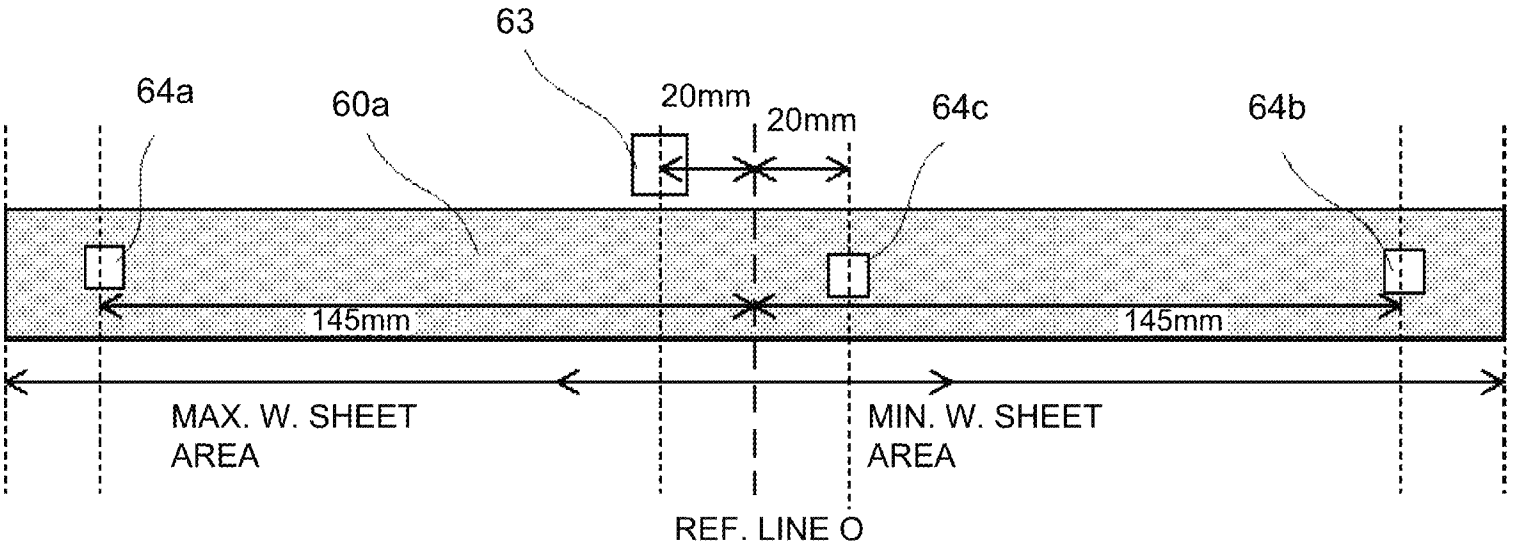
FIG. 9 is an illustration of a position of a temperature detecting element in comparison example 2.

In comparison example 2, as shown in FIG. 9, the heater thermister 64*c* is disposed at 20 mm away from the line O toward the other side in the longitudinal direction of the heater substrate 60*a*, with preference of stabilization of the temperature control. The positions of the sleeve thermister 63 and the heater thermisters 64*a*, 64*b* are the same as those in Embodiment 1 (FIG. 6).

The results will be described.

Figure 10:
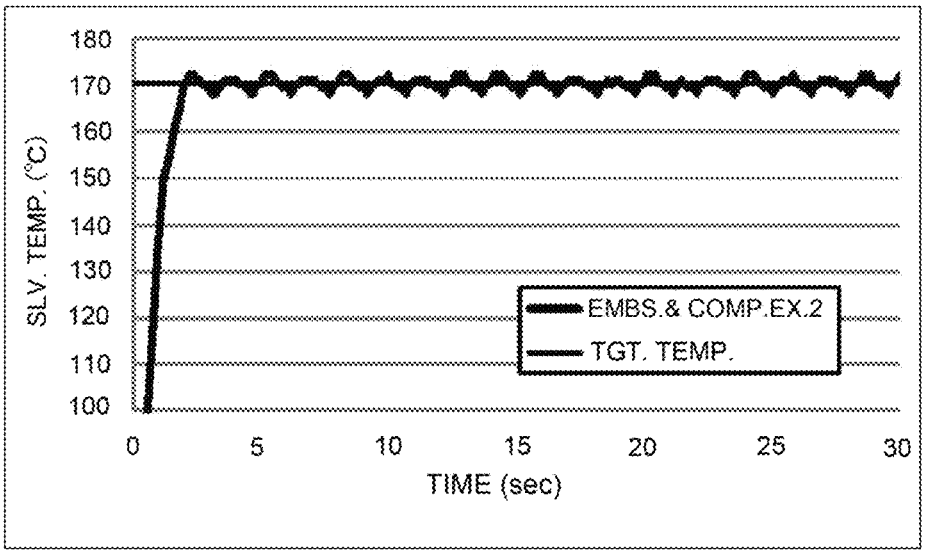
FIG. 10 shows changes of sleeve thermister temperatures in Embodiment 1 and comparison example 2.
Figure 11:
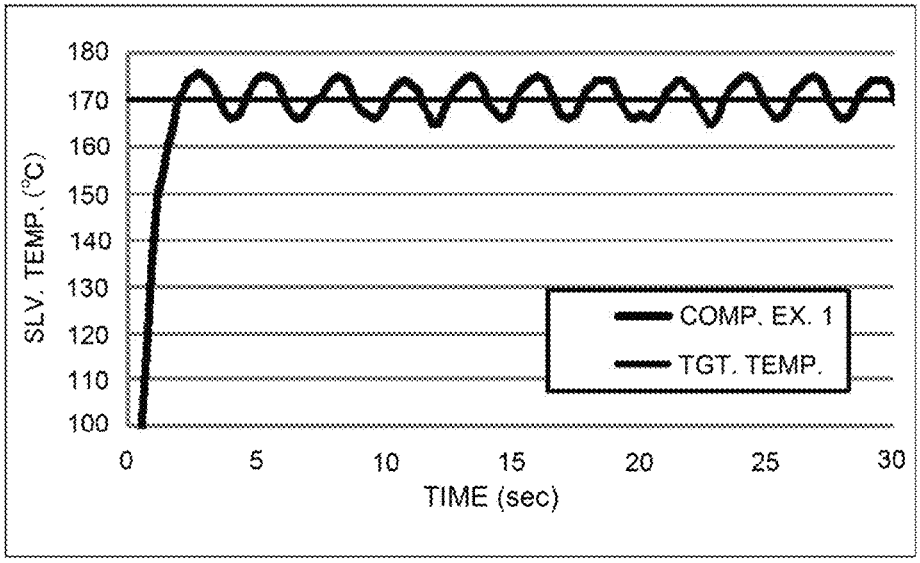
FIG. 11 shows a change of sleeve thermister temperature in comparison example 1.

1) Change of Temperature at the Back Side of the Sleeve:

FIGS. 10 and 11 show the changes of the temperature of the sleeve thermister 63 when A4 size sheets (width 297 mm, length 210 mm) having a basis weight of 81 g/m^2 are continuously printed at 135 mm/s (30 ppm).

In Embodiment 1 and comparison example 2, as shown in FIG. 10, the control can be carried out without significantly deviating from the target temperature, because the temperature control is carried out in the mode using both of the sleeve thermister 63 and the heater thermister 64*c*. On the other hand, in the case of comparison example 1, as shown in FIG. 11, the temperature ripple is so large that it is significantly away from the target temperature because of the temperature control is carried out in the control mode using only the sleeve thermister 63. Because of the satisfactory image quality temperature area is relatively narrow in the case of the process speed of 135 mm/s, the improper fixing and/or hot offset may occur when the sleeve thermister temperature deviates from the target temperature.

2) Non-Sheet-Passage-Part Temperature Rise Detection in Small Size Sheet Processing:

The printing operations are carried out for A6 size sheets (width 105 mm, length 148 mm) having a basis weight of 81 g/m^2 at the process speed of 67.5 mm/s.

Figure 12:
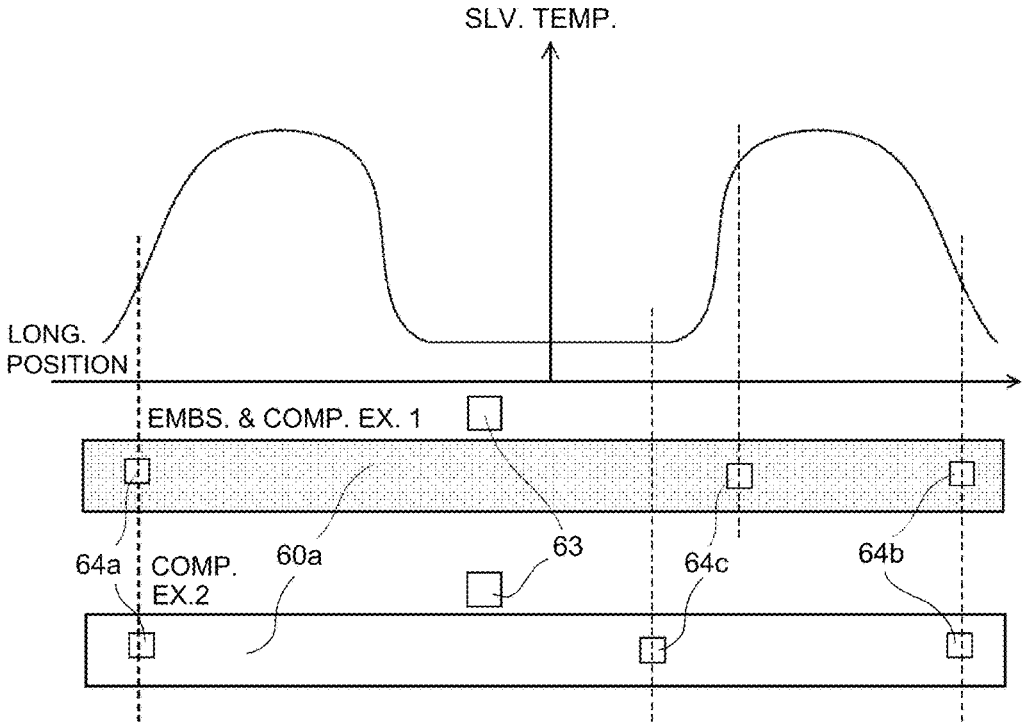
FIG. 12 is an illustration of a longitudinal direction temperature distribution of the heater and a thermister position in each of Embodiment 1 and comparison examples 1 and 2.

FIG. 12 shows a relationship between the sleeve longitudinal direction temperature distribution and the position of the temperature detecting element in the continuous print. In Embodiment 1 and comparison example 1, the non-sheet-passage-part temperature rise can be detected by the heater thermister 64*c*. On the other hand, in comparison example 2, the non-sheet-passage-part temperature rise cannot be detected because the heater thermister 64*c* is disposed within the sheet passing area of the A6 size sheet. In addition, at the positions of the heater thermisters 64*a* and 64*b* (opposite end portions), the non-sheet-passage-part temperature rise is low, and therefore, the detection accuracy is quite greatly deteriorated.

On the other hand, in Embodiment 1 and comparison example 1, the temperature ripple is relatively large because the temperature control is carried out in the control mode using only the sleeve thermister 63. However, as shown in FIG. 7, the satisfactory temperature area for the image quality is wide in the case of the process speed of 67.5 mm/s, and the improper fixing or hot offset hardly occurs.

The results of confirmations relating to the change of the sleeve thermister temperature and the non-sheet-passage-part temperature rise in the small size sheet processing are summarized as follows:

TABLE 1

| | | Embodiments | Comp. Ex. 1 | Comp. Ex. 2 |
|---|---|---|---|---|
| 135 mm/s | Image defect prevention | G | G | F |
| 67.5 mm/s | Non-passage area temp. rise detection | G | N | G |

TABLE 1-continued

| | | Embodiments | Comp. Ex. 1 | Comp. Ex. 2 |
|---|---|---|---|---|
| 67.5 mm/s | Image defect prevention | G | G | G |

As described in the foregoing, the sleeve thermister 63 is disposed at the position within the minimum sheet width area, and the heater thermister 64*c* is disposed at the position outside the minimum sheet width area and within the maximum sheet width area, and the control mode for the temperature control is changed depending on the sheet width of the sheets to be processed. By this, without increasing the number of temperature detecting elements, the non-sheet-passage-part temperature rise can be detected, and the image defect attributable to the temperature ripple can be prevented.

Embodiment 2

Embodiment 2 of the present invention will be described. The structures of the image forming apparatus and the fixing device of this embodiment are similar to those of Embodiment 1 (FIGS. 2-4), and therefore, the description thereof are omitted.

Figure 13:
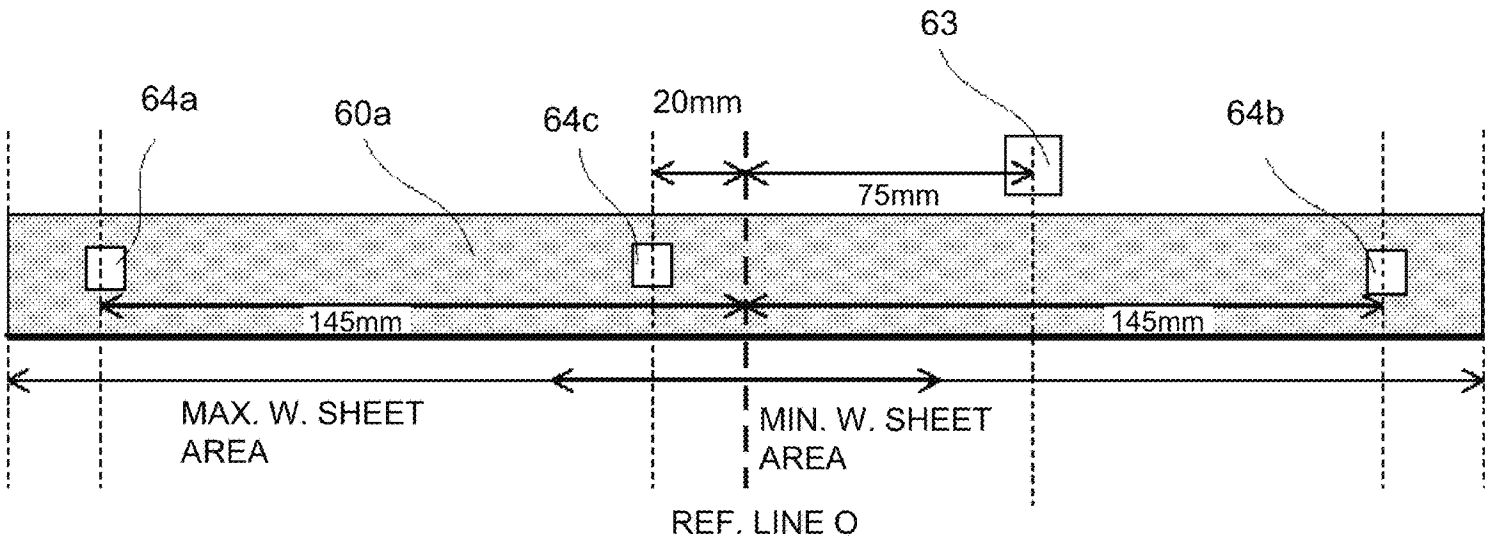
FIG. 13 is an illustration of the position of a temperature detecting element in Embodiment 2 of the present invention.

In Embodiment 2, as shown in FIG. 13, a third heater thermister 64*c* is provided within the width sheet passing area, and the sleeve thermister 63 is disposed in the minimum width sheet non-passing area and within the maximum width sheet passing area. The temperature control is as follows depending on the detection result of the sheet width (recording material size):

1) Not Less than 160 mm of the Recording Material Size:

In this case, the control (first electric power control mode) is the same as in Embodiment 1 More particularly, a target temperature is set for the sleeve thermister 63, and the detected temperature of the sleeve thermister 63 is compared with the target temperature. In response to the difference, the control temperature of the heater thermister 64*c* is changed.

With such a control method, the sleeve thermister temperature is accurately maintained at the target temperature, and the non-sheet-passage-part temperature rise is detected by the heater thermisters 64*a* and 64*b*.

2) Less than 160 mm of the Sheet Width:

In this case, if the deviation of the sheet feeding or a variation of the recording material, what is assuredly within the sheet passing area is the sleeve thermister 64*c* only. Therefore, the temperature control is carried out using the sleeve thermister 64*c*.

When the sheet width is less than 150 mm, the heater thermister 63 can be used for the non-sheet-passage-part temperature rise detection, and therefore, the productivity for the small size sheets can be assured.

On the other hand, in the case that the temperature control is carried out using only the sleeve thermister 64*c*, it is difficult to maintain the temperature of the surface of the sleeve at the predetermined temperature. This is because as shown in FIG. 4, between the surface of the sleeve and the heater thermister 64*c*, a thermal resistance and a thermal capacity of the heater 60 in addition to the sleeve 41, and therefore, the temperature change of the surface of the sleeve cannot be accurately estimated only by the heater thermister 64*c*.

However, the temperature change of the sleeve 41 can be predicted to a certain extent from the print number, the information including the ambient temperature or the like detected by an ambient condition sensor 107 (FIG. 5) of the image forming apparatus. As described hereinbefore, by selecting the 67.5 mm/s of the process speed, as shown in FIG. 7, the satisfactory temperature range is large, and therefore, satisfactory images without the improper fixing or the hot offset.

As described in the foregoing, the sleeve thermister 64*c* is disposed at the position within the minimum sheet width area, and the heater thermister 63 is disposed at the position outside the minimum sheet width area and within the maximum sheet width area, and the control mode for the temperature control is changed depending on the sheet width of the sheets to be processed. By this, without increasing the number of temperature detecting elements, the non-sheet-passage-part temperature rise can be detected, and the image defect attributable to the temperature ripple can be prevented.

The controlling structures of Embodiments 1 and 2 are summarized as follows: It comprises a first temperature detecting element 63 configured to detect a temperature of the sleeve 41 (movable member) and a second temperature detecting element 64*c* configured to detect a temperature of the heater 60 (heating element) It further comprises a controller 100 configured to effect a temperature control for the heater 60 by controlling electric power supply from the voltage source portion 101 to the heater 60 on the basis of the information of the detected temperature of the of the temperature detecting element.

One of the first and second temperature detecting elements 63, 64*c* is in the sheet passing range in which the minimum usable width sheet P passes. The other is outside the sheet passing range in which the minimum usable width sheet P passes and is in the sheet passing range in which the maximum usable width sheet passes. On the other hand, the apparatus is operable in a first electric power control mode in which the electric power supply to the heater 60 is controlled using the both of the temperature detecting elements, and in a second electric power control mode in which the electric power supply to the heater 60 is controlled using only the other temperature detecting element.

The controller 100 select the first electric power control mode or the second electric power control mode depending on the width of the sheet P to be used, when the sheets are continuously introduced for the image formations. When the width of the sheets is not less than a predetermined threshold, the operation in the first electric power control mode is carried out, and when the width is less than the predetermined threshold, the operation in the second electric power control mode is carried out by the controller 100.

The controller 100 is capable of changing the sheet feeding speed between the first feeding speed and the second feeding speed slower than the first feeding speed, and when the width of the sheet is less than a predetermined threshold, the controller 100 select the second feeding speed. When the controller 100 executes the operation in the second electric power control mode, it selects the second feeding speed.

In both of Embodiment 1 and Embodiment 2, the control mode for the temperature control (electric power control mode) is switched depending on the sheet width, so that the temperature detecting element disposed outside the minimum usable width sheet passing area can be used selectively for the temperature control or for the non-sheet-passage-part temperature rise detection. Therefore, the number of the temperature detecting elements can be reduced.

<Others>

(1) In the fixing device 40 of the embodiments, the heater 60 is used also as a back-up member for the sleeve 41 as the movable member, but a separate back-up member may be provided in addition to the heater 60, and the heater 60 is placed at the position different from the back-up member.

(2) The configuration of the movable member 41 is not limited to the cylindrical member or the endless belt. It may be a non-endless web type in the form of a roll.

(3) The movable member 41 may be in the form of an endless belt stretched around a plurality of supporting members.

(4) The heating element 60 for heating the movable member 41 is not limited to the ceramic heater. It may be a Nichrome wire heater, an IH heater of induction heating type using an excitation coil, a halogen heater, or another contact type or non-contact type heater. For the heating of the movable member 41, an inside heating type for heating it from the inside is not inevitable, and an external heating type for heating it from the outside is usable.

(5) The number of thresholds of the sheet width at which the temperature control mode is changed may be three or more. As for the productivity (throughput) control, the intervals of the sheet feeding may be changed without changing the sheet feeding speed.

(6) The image heating apparatus in the foregoing embodiments is an image fixing device for fixing the toner image on the sheet (recording material) by heating the image, but this is not restricting to the present invention. It may be heating device for temporary fixing of the unfixed image on the sheet, or a sheet reheating device for improving the surface property of the image such as gloss or the like.

(7) The image forming apparatus is not limited to the image forming apparatus for forming full-color images but may be monochromatic image forming apparatus. The image forming apparatus may be added with various equipment to be used as a copying machine, a facsimile machine, a multifunction machine having these functions, or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-000487 filed on Jan. 5, 2016, which is hereby incorporated by reference herein in its entirety.

What is claimed is:

1. An image heating apparatus for heating an image on a recording material, said image heating apparatus comprising:

a cylindrical film;

a heater contacting an inner surface of said film;

a roller cooperative with said heater to form a nip with said film;

a first temperature detecting element configured to detect a temperature of said film, said first temperature detecting element being positioned in an area of said film that is passed by a minimum width recording material that is capable of being fed by said apparatus;

a second temperature detecting element configured to detect a temperature of said heater, said second temperature detecting element being positioned in an area of said heater that is outside of an area to be passed by the minimum width recording material and that is passed by a maximum width recording material that is capable of being fed by said apparatus in a perpendicular direction of a feeding direction of the recording material; and a controller configured to control said heater, wherein, said apparatus heats the recording material carrying the image while the recording material passes through the nip, wherein when the recording material, having a width sufficient enough to pass both a position where said first temperature detecting element is provided and a position where said second temperature detecting element is provided, is heated, said controller executes a first heater control for controlling said heater so that the temperature detected by said second temperature detecting element is maintained at a target temperature of said heater, wherein, when the recording material, having a width such that the recording material passes through the position where said first temperature detecting element is provided, but does not pass through the position where said second temperature detecting element is provided, is heated, said controller executes a second heater control for controlling said heater so that the temperature detected by said first temperature detecting element is maintained at a target temperature of said film, wherein, when the first heater control is executed, said controller corrects the target temperature of said heater in accordance with the temperature detected by said first temperature detecting element, and wherein, when the second heater control is executed, a feeding speed of the recording material in said nip is less than that when the first heater control is executed.

2. An image heating apparatus according to claim 1, wherein, in the first heater control, when the temperature detected by said first temperature detecting element is less than the target temperature of said film by a predetermined temperature, said controller increases the target temperature of said heater.

3. An image heating apparatus according to claim 1, wherein, in the area, on said heater, that is passed by a minimum width recording material in the perpendicular direction of the feeding direction of the recording material, said first temperature detecting element and said second temperature detecting element do not exist.

4. An image heating apparatus for heating an image on a recording material, said image heating apparatus comprising:

a cylindrical film;

a heater contacting an inner surface of said film;

a roller cooperative with said heater to form a nip with said film;

a first temperature detecting element configured to detect a temperature of said film, said first temperature detecting element being positioned in an area of said film that is passed by a minimum width recording material that is capable of being fed by said apparatus;

a second temperature detecting element configured to detect a temperature of said heater, said second temperature detecting element being positioned in an area of said heater that is outside of an area to be passed by the minimum width recording material and that is passed by a maximum width recording material that is capable of being fed by said apparatus in a perpendicular direction of a feeding direction of the recording material; and a controller configured to control said heater, wherein said apparatus heats the recording material carrying the image while the recording material passes through the nip, wherein, when the recording material, having a width sufficient enough to pass both a position where said first temperature detecting element is provided and a position where said second temperature detecting element is provided, is heated, said controller executes a first heater control for controlling said heater so that the temperature detected by said second temperature detecting element is maintained at a target temperature of said heater, wherein, when the recording material, having a width such that the recording material passes through the position where said first temperature detecting element is provided, but does not pass through the position where said second temperature detecting element is provided, is heated, said controller executes a second heater control for controlling said heater so that the temperature detected by said first temperature detecting element is maintained at a target temperature of said film, wherein when the first heater control is executed, said controller changes the target temperature of said heater depending on a difference between the target temperature of said film and the temperature detected by said first temperature detecting element, and wherein, when the second heater control is executed, a feeding speed of the recording material in said nip is less than that when the first heater control is executed.

5. An image heating apparatus according to claim 4, wherein, in the first heater control, when the temperature detected by said first temperature detecting element is less than the target temperature of said film by a predetermined temperature, said controller increases the target temperature of said heater.

6. An image heating apparatus according to claim 4, wherein, in the area, on said heater, that is passed by a minimum width recording material in the perpendicular direction of the feeding direction of the recording material, said first temperature detecting element and said second temperature detecting element do not exist.

* * * * *